US009515375B2

(12) United States Patent
Lucci

(10) Patent No.: US 9,515,375 B2
(45) Date of Patent: Dec. 6, 2016

(54) ANTENNA FOR A SUBMARINE

(71) Applicant: CALZONI S.r.l., Calderara di Reno (Bologna) (IT)

(72) Inventor: Marco Lucci, Serravalle (IT)

(73) Assignee: CALZONI S.R.L., Calderara di Reno (IT)

( * ) Notice: Subject to any disclaimer, the term of this patent is extended or adjusted under 35 U.S.C. 154(b) by 281 days.

(21) Appl. No.: 14/519,730

(22) Filed: Oct. 21, 2014

(65) Prior Publication Data

US 2015/0318606 A1 Nov. 5, 2015

(30) Foreign Application Priority Data

Nov. 27, 2013 (IT) ..... BO2013A0649

(51) Int. Cl.

| | |
|---|---|
| ***H01Q 1/34*** | (2006.01) |
| ***H01Q 1/50*** | (2006.01) |
| ***H01Q 1/12*** | (2006.01) |
| ***B63G 8/38*** | (2006.01) |

(52) U.S. Cl.

CPC *H01Q 1/34* (2013.01); *B63G 8/38* (2013.01); *H01Q 1/1235* (2013.01); *H01Q 1/50* (2013.01)

(58) Field of Classification Search

CPC ..... H01Q 1/34; H01Q 1/50
USPC ..... 343/709, 710, 719
See application file for complete search history.

(56) References Cited

U.S. PATENT DOCUMENTS

| | | | | |
|---|---|---|---|---|
| 4,227,479 | A | 10/1980 | Gertler et al. | |
| 6,269,763 | B1 * | 8/2001 | Woodland | A62C 29/00 114/144 A |
| 2007/0175082 | A1 * | 8/2007 | Barrett | A01K 91/02 43/26.1 |

FOREIGN PATENT DOCUMENTS

| | | |
|---|---|---|
| DE | 102006061294 | 4/2008 |
| EP | 1162137 | 12/2001 |

OTHER PUBLICATIONS

Italian Search Report dated Aug. 11, 2014 from counterpart app No. BO20130649.

* cited by examiner

*Primary Examiner* — Peguy Jean Pierre
(74) *Attorney, Agent, or Firm* — Shuttleworth & Ingersoll, PLC; Timothy J. Klima

(57) ABSTRACT

An antenna for submarines comprises a base member extending along a main direction of extension between its bottom end, which is fixable to a structure of a submarine, and its top end, at least one movable stem, juxtaposed with the base member and extending along the main direction of extension between its bottom end and its top end, electrical connection means between the stem and the base member and movement means by which the stem is moved relative to the base member along the main direction of extension between a lowered position and a raised position. The connection means comprise a wire-shaped element extending between two end portions connected to the stem and to the base member, respectively, where at least the end portion connected to the stem is equipped with an underwater connector.

11 Claims, 1 Drawing Sheet

ANTENNA FOR A SUBMARINE

This application claims priority to Italian Patent Application BO2013A000649 filed Nov. 27, 2013, the entirety of which is incorporated by reference herein.

BACKGROUND OF THE INVENTION

This invention relates to an antenna for a submarine.

The invention applies generally to the naval (or nautical) sector and, more specifically, to the production of military submarines.

The submarine is a watercraft capable of surface navigation and which, when necessary, can submerge for more or less extended periods of time to continue navigating underwater.

In this invention, the term "submarine" is used to mean any submersible watercraft, including naval vessels designed mainly for independent operation below the surface of the water and also able to navigate partly above surface.

In other words these naval vessels developed out of traditional "submersible" watercraft and thus fall within the scope of the invention.

During underwater operation, submarines often need to raise one or more antennas (in particular, the high-frequency antenna) above the surface of the water in order to be able to communicate with the outside.

Disadvantageously, the high-frequency antenna is often longer than the submarine sail it is housed in during underwater navigation, which leads to problems connected with its movement and housing because its size is such that it cannot be made as a single component.

To overcome this problem, the prior art teaches the use of an antenna equipped with a stylus (for communication) which is connected to a base member of the antenna by a flexible strap.

More precisely, the base member is made up of two antenna portions connected in series. The bottom portion is equipped with an insulating element and is connected to the tuner of the antenna.

In the prior art forms, the stylus is juxtaposed with the base member and the flexible strap is curved over (to form a sort of parabolic antenna) to connect the top of the base member to the bottom end of the stylus. Thanks to its flexibility, the strap keeps the two parts of the antenna (stylus and base member) connected, even during the vertical movement of the stylus, that is, while the stylus is being extracted.

The antenna (high frequency) thus obtained is of optimum length (approximately 7 metres) thanks to the combination of the different modular components, that is, the stylus, the strap and the base member.

It should be noted that all of the above is housed in a containment and lifting cylinder (for example a mast) located inside the submarine sail and is movable between a first, retracted position and a second, extended position, where the stylus slides vertically relative to the base member, thereby bending the strap.

Disadvantageously, this solution suffers from several drawbacks, connected with the poor insulation of the radiating element as a whole due to the need to use a large number of components which must in turn be perfectly insulated from each other.

SUMMARY OF THE INVENTION

The aim of this invention is to provide an antenna for submarines which overcomes the above mentioned disadvantages of the prior art.

More specifically, the aim of this invention is to provide an antenna for submarines which is highly reliable and easy and inexpensive to make.

Another aim of the invention is to provide an antenna for submarines which is high performing.

These aims are fully achieved by the antenna for submarines according to this invention, comprising the features described in one or more of the appended claims.

BRIEF DESCRIPTION OF THE DRAWINGS

These features of the invention will become more apparent from the following detailed description of a preferred, non-limiting example embodiment of it, with reference to the accompanying drawings, in which.

DESCRIPTION OF THE PREFERRED EMBODIMENTS

Figure 1:
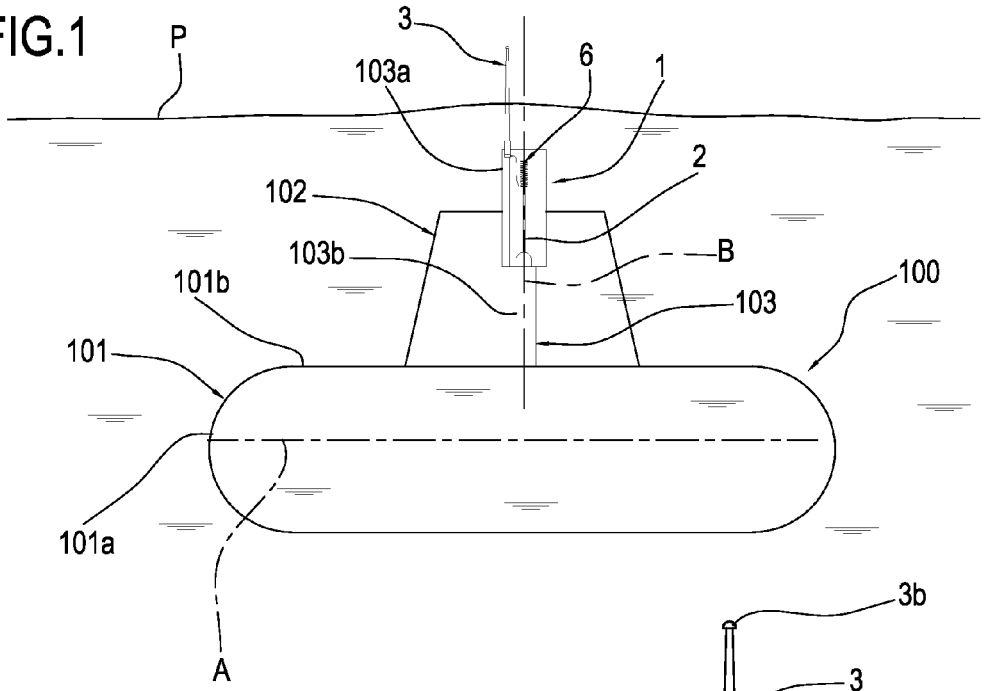
FIG. 1 is a schematic view of a submarine equipped with the antenna according to this invention.
Figure 2:
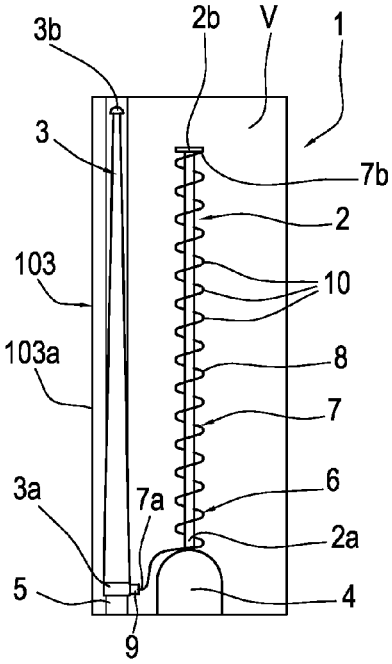
FIGS. 2 and 3 are schematic views of the antenna for submarines according to the invention in two different operating positions.
Figure 3:
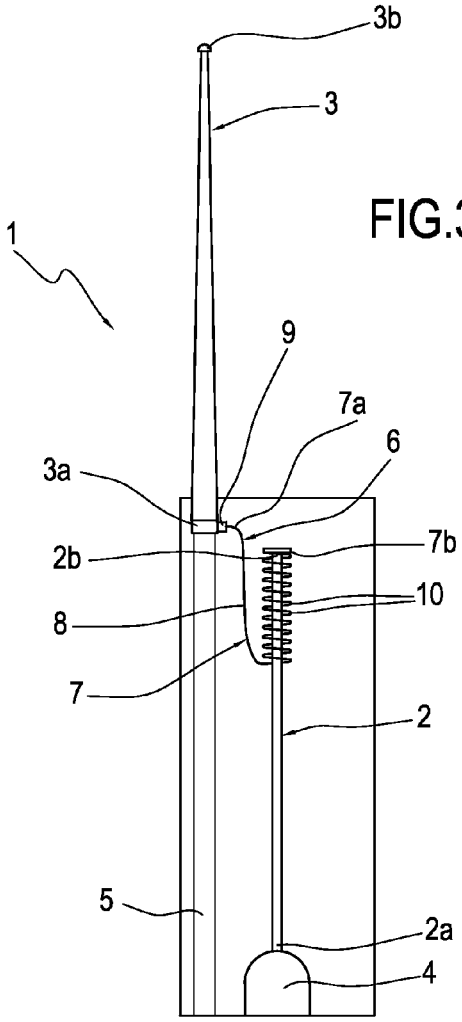

With reference to the accompanying drawings, the numeral 1 denotes an antenna for submarines according to this invention.

The antenna 1 is installed in a submarine 100 to allow the submarine to communicate with the outside world during navigation.

As mentioned above, the submarine 100 is a watercraft capable of surface navigation and which, when necessary, can submerge for more or less extended periods of time to continue navigating underwater.

In this invention, the term "submarine" is used to mean any submersible watercraft, including naval vessels designed mainly for independent operation below the surface of the water and also able to navigate partly above surface.

In other words these naval vessels developed out of traditional "submersible" watercraft and thus fall within the scope of the invention.

The submarine 100 comprises a hull 101 extending lengthways along a respective direction of extension "A" and designed to operate underwater, below the surface "P" of the water.

The hull 101 is elongate in shape and preferably has a streamlined front portion 101*a* to improve water penetration during navigation.

The hull 101 is thus powered to navigate along a respective direction of travel both underwater and (partly) above the surface of the water.

Typically, the hull 101 is divided into two hulls (not illustrated in detail) located one inside the other and between which are defined ballast tanks which are designed to be filled or emptied (through suitable valves) to allow navigation underwater (tanks full) and at the surface (tanks empty).

The hull 101 also comprises an upper portion 101*b* (or back) with a sail 102 (or conning tower) rising up therefrom.

The sail 102 thus defines a protrusion (or projection) extending upwards from the upper portion (or back) of the hull 101 at right angles to its main direction "A".

Inside it, the sail 102 defines a chamber 104 which houses at least one apparatus 103 for lifting a set of devices acting as interfaces with the outside world, including the antenna 1 forming the object of this invention, preferably the high-frequency antenna.

It should be noted that the lifting apparatus 103 is installed in the conning tower 102 which lifts/lowers the antenna 1, at least when the submarine 100 is navigating at periscope depth.

The expression "navigation at periscope depth" is commonly used to mean movement of the submarine 100 in a predetermined direction of travel with the hull submerged (i.e. entirely under the surface "P") and the antenna (or one the other interface devices, such as the snorkel or the periscope) outside the water.

More specifically, the lifting apparatus 103 comprises at least an elongate containing body 103*a* defining a compartment "V" for housing the antenna 1.

The elongate containing body 103*a* is also connected to lifting means 103*b* (which may be hydraulic or electric, without distinction) configured to lift it from a rest position, where it is housed inside the chamber 104, to a working position, where it is at least partly extended outside the chamber 104.

In the preferred embodiment, the elongate containing body 103*a* has a substantially cylindrical geometry, extending vertically (with a circular or elliptic cross section).

The antenna 1, which, as stated, is preferably a high-frequency antenna, comprises at least one base member 2 extending along a main direction of extension "B" between its bottom end 2*a*, which is fixable to a structure of the submarine 100 (in particular, to the elongate containing body 103*a*) and its top end 2*b*.

The base member 2 preferably has a longitudinal shape, that is, one of its dimensions, extending along the main direction "B", is much longer than its other two dimensions.

In other words, the base member 2 is substantially rod shaped and extends rigidly between its two ends 2*a*, 2*b*.

Preferably, the bottom end 2*a* of the base member 2 is rigidly fixed to a tuner 4. Thus, the tuner 4 is interposed between the base member 2 and a mounting structure which supports the lifting apparatus 103 (in particular, the elongate containing body 103*a*).

The term "tuner 4" is used to denote an electronic apparatus which makes it possible to adapt the antenna 1 to transmitting and/or receiving radio waves, thus allowing communication between the submarine 100 and the outside world.

The antenna 1 also comprises a movable stem 3, juxtaposed with the base member 2 (also referred to as "fixed stem") and extending along the main direction of extension B between its bottom end of 3*a* and its top end 3*b*.

Thus, in use, the movable stem 3 extends substantially vertically between its two ends 3*a*, 3*b*. In other words, the stem 3, too, is substantially rod shaped.

To allow movement of the stem 3, the antenna is equipped with movement means 5 by which the stem is moved relative to the base member 2 along the main direction of extension B between a lowered position and a raised position.

At the lowered position, the bottom end 3*a* of the stem 3 is substantially face to face with the bottom end 2*a* of the base member and the top end 3*b* of the stem 3 is substantially face to face with the top end 2*b* of the base member 2.

The movement means 5 thus operate on (and are associated with) the stem 3 in order to raise it relative to the base member 2, thereby increasing the length of the antenna 1 (up to an effective length of approximately 7 metres).

The movement means 5 may be hydraulic (or pneumatic) or electric, without distinction. according to linear or rotary embodiments.

To allow transmission between the stem 3 and the base member 2, the antenna 1 comprises connection means 6 for electrical (and physical) connection between the two.

According to the invention, the connection means 6 comprise a wire-shaped element 7 extending between two end portions 7*a*, 7*b* connected to the stem 3 and to the base member 2, respectively.

The expression "wire-shaped element" is used in this text to denote a long, thin member having flexibility properties such as to allow the stem 3 and the base member 2 to be connected to each other but without in any way preventing relative movement between the two.

In the preferred embodiment, the wire-shaped element 7 is a cable 8 which is not self-bearing, that is, which has rigidity properties making it suitable for resisting the working conditions typical of the application.

More specifically, the wire-shaped element 7 for cable is made from litz wire insulated with a polyurethane sheath.

Preferably, at least the end portion 7*a* connected to the stem 3 is equipped with an underwater connector 9.

In other words, the wire-shaped element 7 is connected to the stem 3 by an underwater connector 9, that is, a connector specifically designed for electrically connecting two components even underwater.

The underwater connector 9 thus has a first and a second connecting portion, connected to the stem 3 and to the end portion 7*a* of the wire-shaped element, respectively, and sealing means (not illustrated) to prevent the connected parts from interacting with the water.

Preferably, also the wire-shaped element 7 has a first end portion 7*a* and a second end portion 7*b* which are connected to opposite ends of the stem 3 and of the base member 2, respectively.

In other words, if the first end portion 7*a* of the wire-shaped element is connected to the bottom end 3*a* of the stem 3, then the second end portion 7*b* is connected to the top end 2*b* of the base member 2, and vice versa.

In the preferred embodiment, the first end portion 7*a* of the wire-shaped element 7 is connected by the underwater connector 9 to the bottom end 3*a* of the stem 3 and the second end portion 7*b* of the wire-shaped element is connected to the top end 2*b* of the base member 2.

In a first variant embodiment, the second end portion 7*b* is connected to the base member 2 by welding.

Alternatively, in a second variant embodiment, not illustrated, also the second portion 7*b* is connected to the base member 2 by an underwater connector, preferably similar to the one which connects the first end portion 7*a* to the stem 3.

In the preferred embodiment, also, the wire-shaped element 7 is wound at least partly round the stem 3 or round the base member 2.

More precisely, the wire-shaped element 7 extends at least partly (preferably mainly) helically round the stem 3 or round the base member 2, wrapping it in a plurality of coils 10.

Thus, he wire-shaped element 7 is deformable by compression, as a function of the position of the stem 3 relative to the base member 2, between an extended configuration, where the coils 10 around the base member 2 (or around the stem 3) are spaced far apart, and a compressed configuration, where the coils 10 around the base member 2 (or around the stem 3) are close together.

Advantageously, the presence of the wire-shaped element 7 wound round one of the two parts of the antenna creates inductance in the middle of the antenna 1, thereby improving the performance of the transmission system in terms of both electric field and magnetic field.

More precisely, the wire-shaped element 7 (cable 8) displaces the resonance frequency of the antenna 1, so that the resulting equivalent antenna is longer than the physical length of the antenna.

It should be noted that the term "equivalent antenna" is used to mean the antenna whose physical length is such as to resonate the frequency.

Moreover, by varying the number of coils 10 of the wire-shaped element wound round the base member 2 (or round the stem 3) it is possible to calibrate the resonance frequency of the antenna 1.

More precisely, increasing the number of coils 10 raises the resonance frequency.

On the other hand, decreasing the number of coils 10 lowers the resonance frequency.

In the embodiment illustrated, the wire-shaped element 7 is connected to the bottom end 3*a* of the stem 3 (by the underwater connector 9) and is wound helically round the base member 2.

In an alternative embodiment (not illustrated) the antenna 1 comprises a plurality of juxtaposed stems 3 and a plurality of wire-shaped elements 7 which connect them to each other (in series) by means of respective underwater connectors 9.

The invention achieves the preset aims and brings important advantages.

In effect, the use of a coiled cable (wire-shaped element) overcomes the disadvantage of poor insulation of the radiating element since the only point of electrical connection between the wire-shaped element and the stem is the underwater connector.

Moreover, the inductance created in the middle of the antenna improves the performance of the transmission system in terms of both electric field and magnetic field.

What is claimed is:

1. An antenna for submarines, comprising:

a base member extending along a main direction of extension between a base member bottom end, which is fixable to a structure of a submarine, and a base member top end;

at least one movable stem, juxtaposed with the base member and extending along the main direction of extension between a movable stem bottom end and a movable stem top end;

electrical connection means between the movable stem and the base member;

movement means by which the movable stem is moved relative to the base member along the main direction of extension between a lowered position and a raised position;

wherein the connection means comprise a wire-shaped element extending between two end portions connected to the movable stem and to the base member, respectively, where at least the end portion connected to the stem is equipped with an underwater connector.

2. The antenna for submarines according to claim 1, wherein the wire-shaped element has a first end portion and a second end portion connected to opposite ends of the movable stem and of the base member, respectively.

3. The antenna for submarines according to claim 2, wherein the first end portion of the wire-shaped element is connected by the underwater connector to the bottom end of the movable stem and the second end portion of the wire-shaped element is connected to the top end of the base member.

4. The antenna for submarines according to claim 2, wherein the wire-shaped element extends at least partly helically round the movable stem or round the base member, wrapping the movable stem or the base member, respectively, in a plurality of coils.

5. The antenna for submarines according to claim 4, wherein the wire-shaped element is deformable by compression, as a function of a position of the movable stem relative to the base member, between an extended configuration, where the coils around the movable stem or around the base member are spaced far apart, and a compressed configuration, where the coils around the movable stem or around the base member are close together.

6. The antenna for submarines according to claim 1, wherein the end portion of the wire-shaped element connected to the base member is welded to the bottom end or top end of the base member.

7. The antenna for submarines according to claim 1, wherein the end portion of the wire-shaped element connected to the base member is equipped with an underwater connector.

8. The antenna for submarines according to claim 1, wherein the bottom end of the base member is connected to a tuning apparatus.

9. The antenna for submarines according to claim 1, wherein the wire-shaped element includes a litz wire insulated with a polyurethane sheath and coiled.

10. A lifting apparatus for interface devices of a submarine, comprising:

an elongate containing body defining a housing compartment;

means for lifting the elongate containing body relative to a structure of a submarine;

an antenna according to claim 1, housed at least partly inside the elongate containing body.

11. The lifting apparatus according to claim 10, wherein the movable stem movement means are associated with the elongate containing body and are configured to move the movable stem by at least one chosen from extending and retracting the movable stem relative to the elongate containing body.

* * * * *